US008146503B2

(12) United States Patent
Murray et al.

(10) Patent No.: US 8,146,503 B2
(45) Date of Patent: Apr. 3, 2012

(54) LINEAR SHAPED CHARGE SYSTEM

(75) Inventors: Chris John Murray, Bronte (AU); Scott Maxwell Allman, Peakhurst (AU)

(73) Assignee: Rapid Entry Pty Limited, Moore Park NSW (AU)

( * ) Notice: Subject to any disclaimer, the term of this patent is extended or adjusted under 35 U.S.C. 154(b) by 204 days.

(21) Appl. No.: 12/434,705

(22) Filed: May 4, 2009

(65) Prior Publication Data

US 2009/0301334 A1 Dec. 10, 2009

Related U.S. Application Data

(63) Continuation-in-part of application No. 10/536,468, filed as application No. PCT/AU03/01585 on Nov. 28, 2003, now Pat. No. 7,536,956.

(30) Foreign Application Priority Data

Nov. 28, 2002 (AU) ..... 2002952984

(51) Int. Cl.
*F42B 12/00* (2006.01)

(52) U.S. Cl. ..... 102/476; 102/306; 102/307; 102/309; 89/1.14

(58) Field of Classification Search ..... 102/305, 102/306, 307, 476, 309; 89/1.14
See application file for complete search history.

(56) References Cited

U.S. PATENT DOCUMENTS

| | | | | |
|---|---|---|---|---|
| 2,605,704 | A | 8/1952 | Dumas | |
| 3,185,089 | A | 5/1965 | Parkhurst et al. | |
| 3,777,663 | A | 12/1973 | Brown | |
| 4,014,719 | A | 3/1977 | Wells | |
| 4,014,720 | A | 3/1977 | Wells | |
| 4,109,575 | A * | 8/1978 | Hashimoto | 102/305 |
| 4,628,819 | A | 12/1986 | Backofen et al. | |
| 4,658,726 | A | 4/1987 | Held | |
| 4,693,181 | A | 9/1987 | Dadley et al. | |
| 4,905,601 | A * | 3/1990 | Gabriel et al. | 102/307 |
| 4,982,665 | A | 1/1991 | Sewell et al. | |
| 5,170,004 | A * | 12/1992 | Garrison | 89/1.14 |
| 5,415,101 | A | 5/1995 | Brinkmann | |
| 5,798,477 | A | 8/1998 | Givens et al. | |
| 6,269,725 | B1 | 8/2001 | Cherry | |
| 6,378,438 | B1 | 4/2002 | Lussier et al. | |
| 6,962,634 | B2 | 11/2005 | Nielson et al. | |
| 2002/0096079 | A1 | 7/2002 | Alford | |
| 2003/0131722 | A1 | 7/2003 | Donovan | |

FOREIGN PATENT DOCUMENTS

| | | |
|---|---|---|
| EP | 0 581 668 A1 | 2/1994 |
| FR | 2 669 723 | 5/1992 |
| GB | 2 148 463 A | 5/1985 |
| GB | 2 176 878 A | 7/1987 |

OTHER PUBLICATIONS

English abstract of FR 2669723 dated May 29, 1992.

* cited by examiner

*Primary Examiner* — Gabriel Klein
(74) *Attorney, Agent, or Firm* — Ladas & Parry LLP

(57) ABSTRACT

A linear charge system (100) for applying a destructive explosive charge to a barrier structure; said system comprising a charge carrier (101) and an explosive charge element (120) assembled within said charge carrier (101); said explosive charge element (120) adapted to effect a directed explosive charge for the penetration of a said barrier in which a tamping fluid forms at least a portion of a penetrating agent.

13 Claims, 7 Drawing Sheets

Fig. 7B
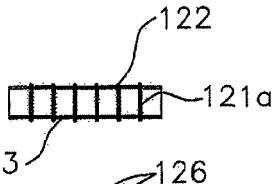
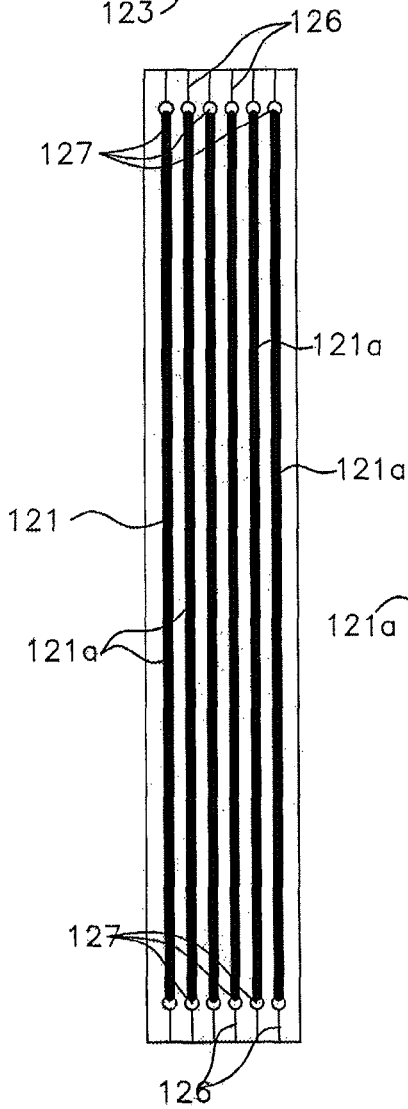
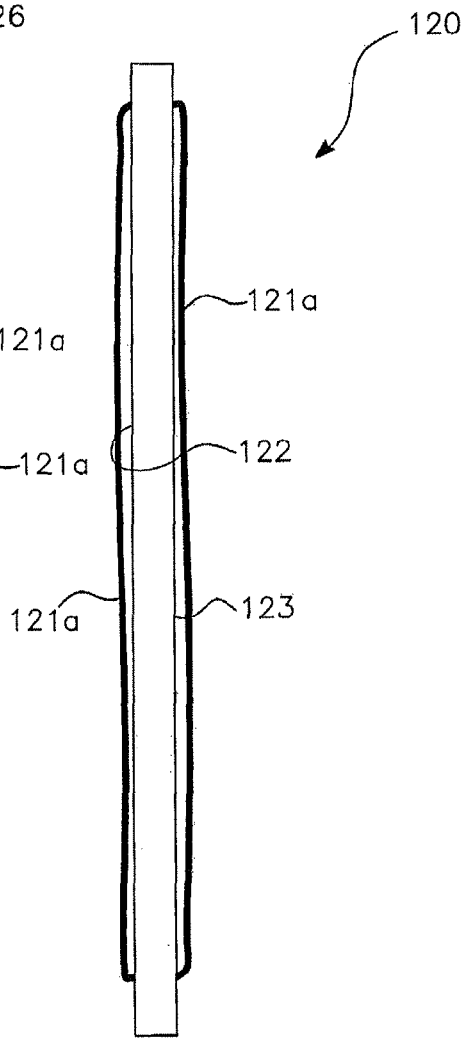
Fig. 7 Fig. 7A

LINEAR SHAPED CHARGE SYSTEM

This application is a continuation-in-part of application Ser. No. 10/536,468 filed on Mar. 27, 2006 now U.S. Pat. No. 7,536,956, which is a 371 of International Application AU03/001585 filed on Nov. 28, 2003, which designated the U.S., claims the benefit thereof and incorporates the same by reference.

The present invention relates to systems and methods adapted to shaped charge systems for the controlled application of a destructive explosive charge and, more particularly for the gaining of forced entry into buildings and structures in situations where such entry is required for military or law enforcement purposes and where such entry is denied.

BACKGROUND

In both military and law enforcement operations it may become necessary to gain forced entry into buildings where such entry by normal means is denied. Some examples of such situations may include the rescue of hostages or the interdiction of serious criminal activity. In such situations the more conventional means of forced entry by the use of rams or sledge hammers and the like may be rendered ineffective by the particular structural or barricaded entry conditions of the building.

In such situations the only recourse may be to use explosive entry techniques. These are high risk operations, with known methods making use of metal fragments to effect penetration at the desired point of entry, with risk of injury to the occupants of the building, or even of the operational personnel.

Numerous forms of linear shaped charges may be employed for these purposes as well as for a range of civil applications, particularly in controlled demolition work. Known systems suffer from a number of shortcomings depending on the particular application and the type of charge system. Thus those systems which employ rigid metal liners cannot be applied to curved surfaces and the metal ejecta generated by the liner presents a danger to personnel. Malleable linear charges are known but only allow relatively limited bending.

It is an object of the present invention to offer systems of forced entry using explosive means in which the explosive effect is limited to an extremely short range, or otherwise addresses or ameliorates the above disadvantages.

Notes

1. The term "comprising" (and grammatical variations thereof) is used in this specification in the inclusive sense of "having" or "including", and not in the exclusive sense of "consisting only of".
2. The above discussion of the prior art in the Background of the invention, is not an admission that any information discussed therein is citable prior art or part of the common general knowledge of persons skilled in the art in any country.
3. The term "tamping" as used in this specification generally indicates a reactive body or substance serving to restrict or direct an explosive discharge; analogous to the tamping of material above a bore hole charge for example.

BRIEF DESCRIPTION OF INVENTION

Accordingly, in a first broad form of the invention, there is provided a linear charge system for applying a destructive explosive charge to a barrier structure; said system comprising a charge carrier and an explosive charge element assembled within said charge carrier; said explosive charge element adapted to effect a directed explosive charge for the penetration of a said barrier in which a tamping fluid forms at least a portion of a penetrating agent.

Preferably, at least a portion of said tamping fluid is rearward of said explosive charge element.

Preferably, at least a portion of said tamping fluid is forward of said explosive charge element.

Preferably, said barrier structure includes domestic and commercial metal roller doors, metal doors, fire doors, reinforced timber doors and glass doors.

Preferably, said charge carrier is comprised of an elongate body of hollow section polymeric material; said elongate body provided with a sealing end cap at a first end and a filler end cap at a second end; said filler end cap provided with an aperture and closure means adapted to allow the filling of said body with said tamping fluid.

Preferably, the internal walls of said elongate body are pre-coated with a gelling agent adapted to modify said tamping fluid into a tamping gel when said fluid is added to said elongate body.

Preferably, said elongate body is provided with an adjustable foot element adapted to provide a height adjustment facility to said elongate body.

Preferably, said elongate body is provided with an adjustable hinged brace.

Preferably, said elongate body is provided with flexible magnetic strips disposed along portions of the front face of said body, said strips adapted to attach said charge carrier to a ferrous metal surface.

Preferably, said elongate body is provided with internal guide rails adapted to accept said explosive charge element; said explosive charge element comprising a loading card sliding into selected said internal guide rails as a sliding fit.

Preferably, said loading card comprises an elongate polymeric extrusion having front and rear wall separated by transverse dividing elements so as to form a number of longitudinal passages through the length of said loading card.

Preferably, said loading card is provided with a series of slots and holes disposed at each end of said card; said holes and slots adapted to accept and retain a winding of detonating cord laid along the front face of said card so as to form said explosive charge element, Preferably, said explosive charge element includes a flexible frangible explosive cutting sheet; said flexible frangible explosive cutting sheet placed in front of said detonating cord.

Preferably, said explosive charge element comprises said flexible frangible explosive cutting sheet, the matrix of said cutting sheet containing a distributed explosive agent; said flexible frangible explosive cutting sheet positioned along said front face of said loading card.

Preferably, said elongate body, said sealing end cap, said filler end cap, said loading card and said explosive charge element are provided disassembled for assembly at a site for use.

In a further broad form of the invention, there is provided a method of preparing a linear charge system for penetration of a barrier structure; said method including the steps of;

(a) preparing a length of loading card with an explosive charge element,
(b) mounting said loading card within an elongate body of a charge carrier at a desired stand-off distance,
(c) assembling a sealing cap to a filler end of said elongate body,
(d) filling said elongate body with a tamping fluid.

Preferably, said explosive charge element is a length of detonating cord; said length of detonating cord wound across a face of said loading card.

Preferably, said explosive charge element is a length of flexible frangible explosive cutting sheet; said cutting sheet positioned along a face of said loading card.

BRIEF DESCRIPTION OF THE DRAWINGS

Embodiments of the present invention will now be described with reference to the accompanying drawings wherein:

FIGS. 7, 7A and 7B are front, side and end views respectively of a loading card according to the invention.

DETAILED DESCRIPTION OF PREFERRED EMBODIMENTS

In at least some preferred embodiments of the present invention a flexible frangible cutting sheet may be used with explosive charges to cut through obstructing material. The structure of this cutting sheet is made up of a polymer matrix including plasticisers, stabilizers and flexible agents and contains a substantially uniform distribution of powdered metal. The metal may be any one of a selection of metals including for example, copper, aluminium, brass, ferrous metals, ceramics or a combination of these.

Preferably the particulate size of the metal or ceramic powder is in the order of 1 to 10 microns but both smaller and larger particles may be used. Different combinations of sheet thickness, particle density and particle size may be formulated depending on the explosive charge to be used and the nature of the barrier structure to be penetrated. That structure may comprise a wide range of materials including wood, metal, masonry, glass, polycarbonates and other plastics as well as composites.

The flexible nature of the cutting sheet enables it to be formed into a variety of elongate shaped charges when provided with an explosive agent. Desired shapes may also be achieved by extrusion, casting or fabricating.

By use of a suitably shaped support structure to provide a stand-off distance between the frangible cutting sheet and the surface to be penetrated, the arrangement may be adapted to take advantage of the "Monroe Effect" wherein the detonation of the explosive agent creates a high energy linear jet of gas. The stand-off arrangement serves to provide a distance between the explosive agent and the target required for the accelerating gas and particles of the cutting sheet to reach an effective penetration velocity.

It is a feature of the flexible frangible cutting sheet that the individual particles accelerated by the blast are of very low mass and thus lose energy rapidly from their initial high energy state after detonation of the explosive agent. As a result their penetration effect is limited to a very short range, thus minimizing fragmentation and the likelihood of unintended injury to any persons within the structure to be penetrated.

In an extruded form, the flexible frangible cutting sheet may be backed with a sheet explosive agent to obtain the desired cutting effect. Furthermore, extruded forms may be placed in a carrier adapted to incorporate a fluid or fluid tamping means, as is further set out below.

In a second preferred form of a cutting sheet, the polymer matrix of the flexible frangible cutting sheet is itself permeated with an explosive charge to produce a flexible frangible explosive cutting sheet. As with the first preferred form, this sheet may be formed by a variety of means including extrusion, casting and fabrication, and may be shaped and combined with a suitable stand-off structure to produce a "Munroe Effect" discharge when detonated.

First Preferred Embodiment

Figure 1:
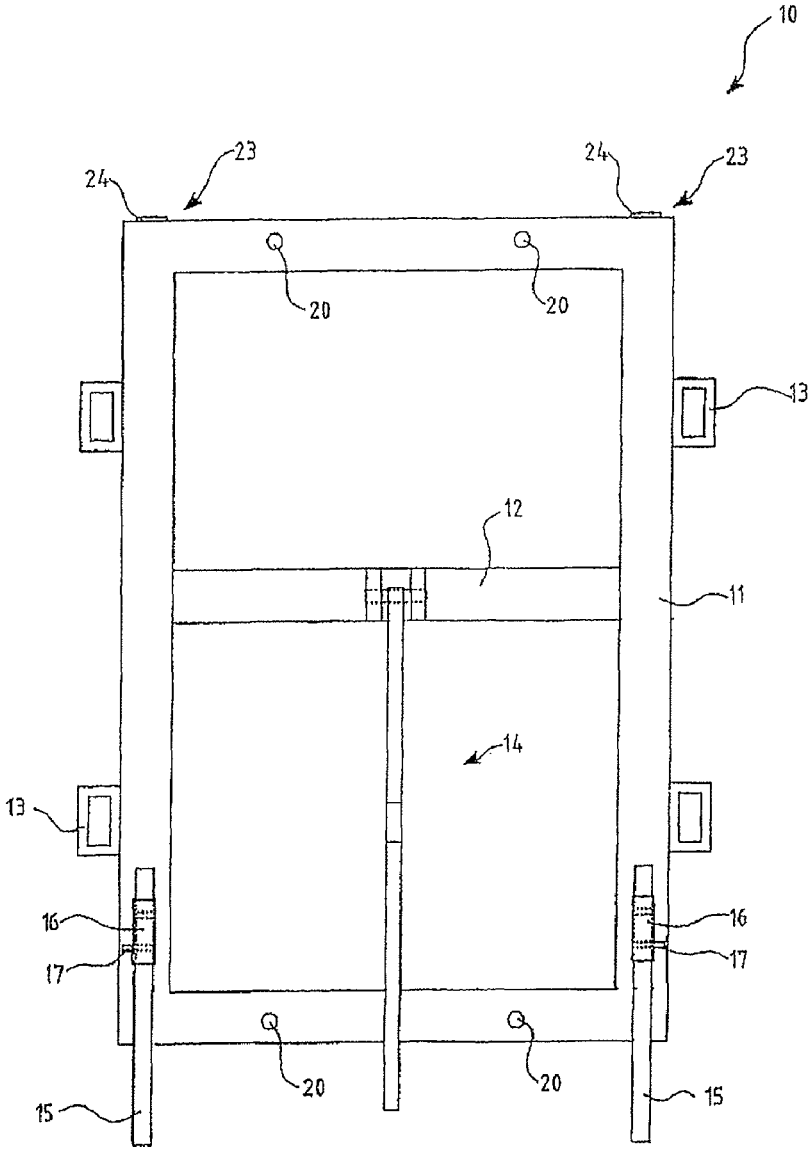
FIG. 1 is a rear elevation view of a first embodiment of a charge carrier according to the invention.
Figure 2:
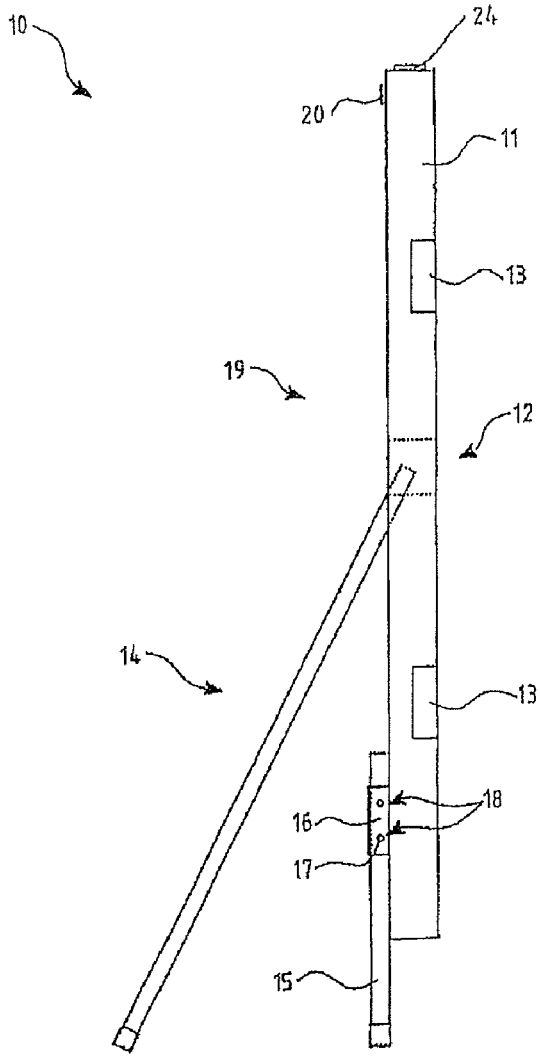
FIG. 2 is a side elevation of the charge carrier of FIG. 1.

With reference now to FIGS. 1 and 2, a first preferred embodiment of a charge carrier (10) is particularly adapted to the penetration of masonry walls, including single, double and cavity brick walls, concrete block walls and light formed concrete walls. A perimeter frame (11) is formed of polymeric hollow section and includes at least one cross member (12). Carrier perimeter frame (11) may further be provided with carry handles (13) and a telescopically adjustable hinged support brace (14). Height adjustment of the frame may be provided by means of foot elements (15) sliding in sleeves (16) and located at a preferred height by locking pegs (17) passing through a plurality of holes (18) in sleeves (16).

Arranged at intervals on the rear face (19) of frame (11), that is that face directed away from the surface to be penetrated, is a plurality of charging ports (20) to allow for detonation of the explosive charge elements carried by the frame.

Figure 4:
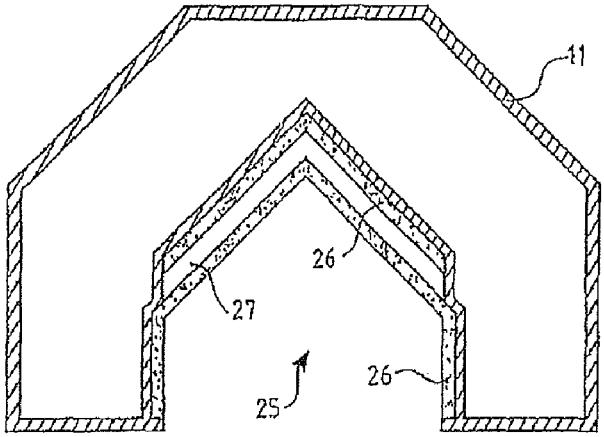
FIG. 4 is a cross sectional view of the member of FIG. 3 with an elongate shaped explosive charge element installed.
Figure 3:
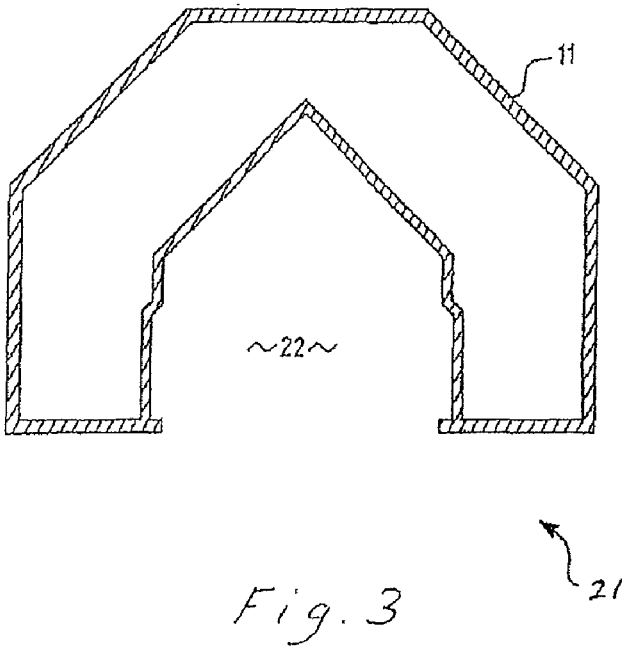
FIG. 3 is a cross sectional view of a member of the charge carrier of FIGS. 1 and 2.

One preferred sectional shape of a perimeter frame (11) and cross member (12) is shown in FIG. 3. The front face (21) of the extruded sections, that is the face directed towards the surface to be penetrated, is shaped with a holding channel (22) adapted to receive as a snap-fit, as shown in FIG. 4, pre-formed elongate charge elements of either the flexible frangible cutting sheet or the flexible frangible explosive cutting sheet type as described above. The frame members may be extruded in a variety of cross sectional shapes and charge holding cavities to suit various operational conditions and charge element shapes.

Again with reference to FIGS. 1 and 2, frame (11) is sealed and is provided with filler ports (23) and closure caps (24) so that the frame may be filled with a tamping agent such as water. Optionally, frame (11) may be prepared at manufacture with a gelling agent so as to create a gel when the frame is filled with water to prevent leakage in the case of accidental fracture of the frame in an operational situation.

The frame charge element holding cavity (22) is preferably so configured as to obviate the need for the charge element to be provided with stand-off material; the required stand-off distance being provided by the frame itself as shown for example in FIG. 4. Here an elongate shaped charge (25) comprising flexible frangible cutting sheet (26) and explosive agent (27) has been fitted to cavity (22).

Second Preferred Embodiment

Figure 5:
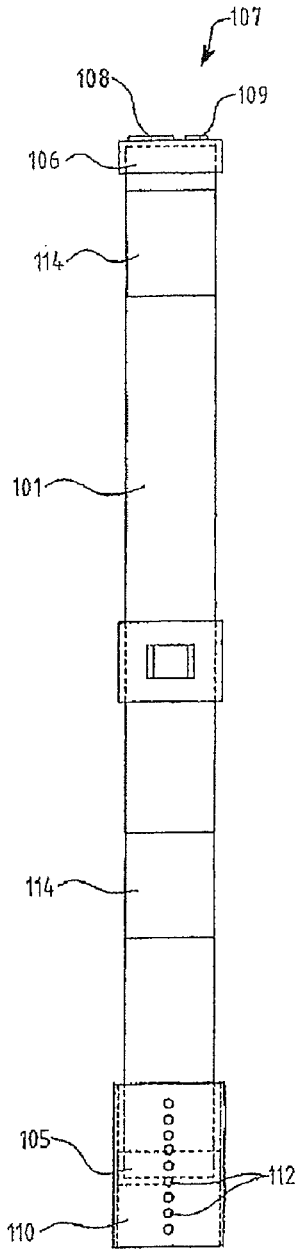
FIGS. 5 and 5A are rear elevation and side views respectively of a second embodiment of a charge carrier according to the invention.
Figure 5A:
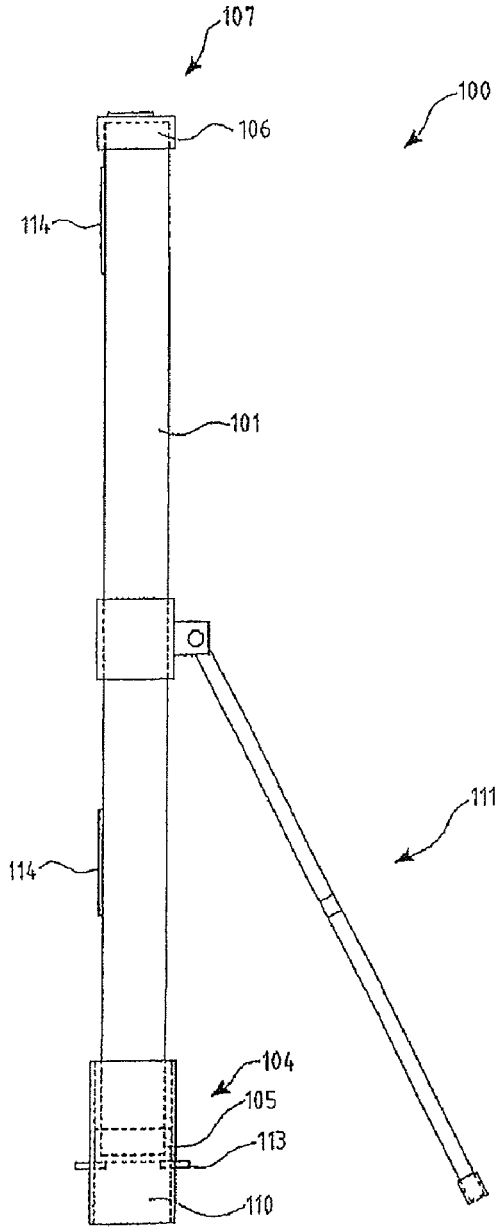

In a second preferred embodiment of a charge carrier according to the invention as shown in FIGS. 5 and 5A, carrier 100 is adapted to effect a directed explosive charge in which a fluid such as water acts as a tamping agent and at least partly as the penetrating agent. In this arrangement a first volume (133) of the tamping fluid is positioned rearward of an explosive charge element (120) and a second volume (135) of the tamping fluid is positioned forward of the explosive charge element.

This second preferred embodiment is adapted in particular to any of a variety of door constructions, including commercial or domestic metal roller doors, metal doors, fire doors, reinforced timber doors and glass doors. It may also be used for some wall structures.

As shown in FIGS. 5 and 5A, charge carrier (100) has an elongate body (101) preferably formed of an extruded polymer section (as can best be seen in FIG. 6), although it may also be formed as a casting or fabrication. The composition of the polymeric elongate body (101) may include plasticizers to reduce brittleness. The elongate body (101) may be of any desired length depending on the intended application but is preferably in the range of 1.2 to 1.8 meters. Although a rectangular section is preferred, the elongate body (101) may be square, triangular, oval or circular.

Figure 6:
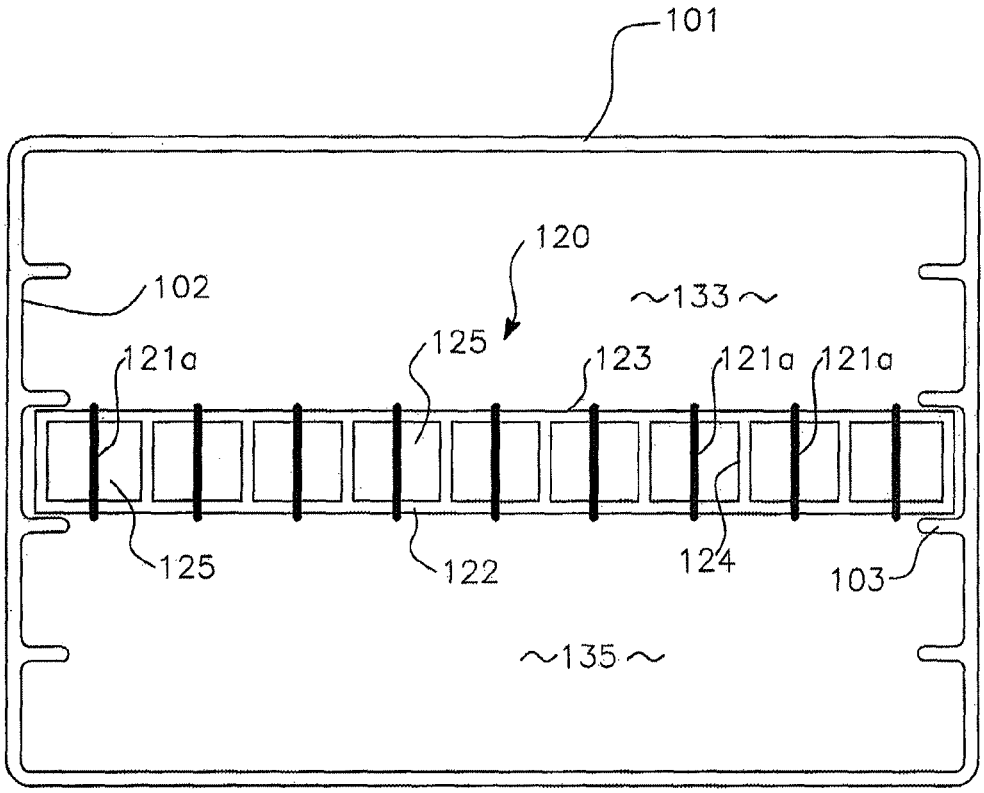
FIG. 6 is a cross sectional view of the charge carrier of FIGS. 5 and 5A.

As shown in FIG. 6, the internal side walls (102) of elongate body (101) are provided with projecting guide rail elements (103). Referring again to FIGS. 5 and 5A, elongate body (101) is sealed at a first end (104) with a sealing end cap (105) and provided with a filler end cap (106) for closure at a second end (107). Filler end cap (106) is further provided with an aperture (131), a closure cap (108) and a detonating cord grommet (109) as shown more clearly in FIGS. 10, 10A and 10B.

Sealing end cap (105) may be permanently assembled to elongate body (101) during manufacture, while filler end cap (105) remains detachable until the carrier is prepared for use at a detonation site. Alternatively, both end caps may be supplied loose so as to allow detonation access to both ends of the elongate body.

Elongate body (101) may further be provided with an adjustable foot portion (110) to allow for height adjustment and a telescopically adjustable hinged support brace (111). Adjustable foot portion (110) may be formed of a sleeve of larger section than the sealing end cap (105) and be provided with a plurality of adjustment holes (112) for the insertion of suitable locking pegs (113). Additionally, elongate body (101) may be fitted with flexible magnetic strips (114) so as to allow for its attachment to metal surfaces.

Guide rail elements (103) are adapted to locate an explosive charge element (120). In a first form as shown in FIGS. 6, 7 and 7A, the explosive charge element (120) is comprised of a loading card (121) and detonating cord (121*a*). Preferably, loading card (121) is in the form of a rectangular sectioned extruded polymer section having front and rear wall portions (122) and (123) with a plurality of transverse divider portions (124) so as to form a number of longitudinal passages (125) between the two wall portions, as best seen in FIG. 6. The thickness of the card is such as to slide as a friction fit between rail elements (103). In one preferred form of the explosive charge element (120) as shown in FIG. 7 the outer ends of the loading card (121) are provided with slots (126) and holes (127) coinciding with passages (125).

In this form a desired length of detonating cord may be installed as lying along the face of the front wall portion (123) of the card, looping through the slots and holes so as to locate the cord to the card. Alternatively, the detonating cord may be threaded through the passages (125) and so wound about the front wall portion (122), or through the passages (125) and around the rear wall portion (123).

In Use

In use, a length of loading card is prepared with a length of detonating cord, lengths of both card and detonating cord selected according to the expected force required to achieve penetration. A variety of explosive charge elements may be prepared for future use. When needed, one or more suitable charges may thus be immediately available and taken to a site for use with the appropriate charge elongate body or bodies, sealing end and filler end caps in disassembled form for assembly on sit In the case of the second preferred embodiment described above, the explosive charge element (120) is inserted into the guide rail elements (103) to provide a desired stand-off distance. The detonating cord is passed through the grommet (109) of the filler end cap 106 and the cap assembled to the elongate body (101), for example by the use of a suitable adhesive.

The elongate body is then filled with a tamping fluid. Optionally, in the case of water as the tamping element, the elongate body (101) may have been previously prepared with a lining of a suitable gelling agent so that when filled, the fluid forms into a gel thus preventing leakage of the tamping fluid in the event of accidental fracturing of the elongate body, or alternatively a gelling agent may be added with the fluid.

Again in the case of the second preferred embodiment, when detonated, the charge on the loading card, explosively accelerates the tamping fluid in front of the explosive charge through the elongate body and into the target. Thus in this case this portion of the tamping fluid becomes a part of the penetrating agent.

Other tamping agents than water may be used such as the fluid substances sand or soil. These agents can be readily introduced into the charge body through the large filling port.

The effectiveness of the penetrating operation of the second charge carrier embodiment of FIGS. 5 to 8 may be enhanced by the placement of a flexible frangible cutting sheet (134) in front of the detonating cords 132 as shown in FIG. 6B, or alternatively, replacing the detonating cord with a flexible frangible explosive cutting sheet. This sheet may be attached to the loading card by adhesive tape, for example or be adapted to slide into slide rails between the loading card (121) and the target side of the explosive charge element (120).

This second embodiment of an explosive charge element (120) in the elongate body (101) according to the invention described above is particularly suited to the forced entry of doorways where there is a perceived asymmetry of strength in the door structure. Thus for example in a roller door situation, the charge is effective in urging that side of the door from its guide rail when the elongate body is aligned adjacent to an edge of the roller door.

An advantage of the present embodiment is that the flexibility of the system allows it to be prepared, if required, on-site to suit a wide range of forced entry requirements.

The elongate body (101) and the explosive charge element (120) are designed so that the explosive charge can be tamped in a number of different ways. It can be located to act as an outright fracturing charge to take advantage of the brisance of the explosive detonation.

Alternatively as indicated above for the second preferred embodiment, the charge can be located between volumes of the tamping element. In this configuration the tamping volume away from the target, that is at the rear of the explosive charge element, acts as a tamping agent, increasing the effectiveness of the explosion and minimizing overpressure effects. The side towards the target conveys explosive energy into the target material. Water, or gelled water is the optimum tamping material, offering excellent confinement with no shrapnel concerns.

With a loading card (121) which has been pre-assembled with the explosive load, it takes only moments to prepare the charge carrier (100). An advantage of the separate loading card is that only it, needs be stored in an explosive magazine; the other components may be stored in any convenient way. Various loading cards of different lengths and with varying explosive loads may be pre-assembled and stored in anticipation of use.

Alternatively, the components to make up the charge carrier (100) described above and shown in exemplary configuration in FIGS. 5 to 8, may be provided in a disassembled kit form. The kit then includes at least one length or a selection of lengths of polymer extrusion, a matching length or lengths of loading card, a sealing end cap and a filler end cap, as well as sufficient length of detonating cord and gelling agent. The sealing end cap may be pre-assembled to the elongate body but an alternative form of the kit may be supplied with two loose filler end caps thus allowing two or more charge carriers to be linked together into one explosive charge assembly.

In addition the kit may be provided with a roll of double sided adhesive tape to allow the charge elongate body to be directly attached to a surface. Where adhesion is not possible because of the nature of the surface, a support structure may be included in the kit in the form of the adjustable foot portion and hinged support brace as described above.

Figure 8A:
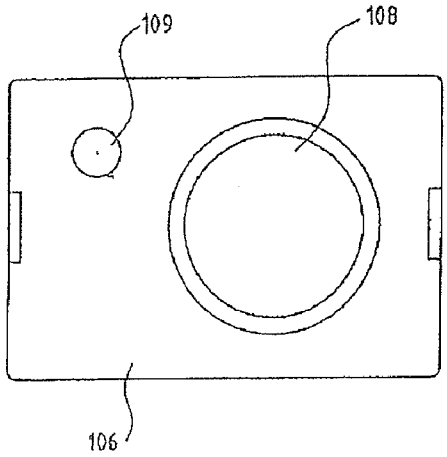
FIGS. 8, 8A and 8B detail elevation, plan and side views of a filling end cap of the charge carrier of FIGS. 5 and 5A.
Figure 8B:
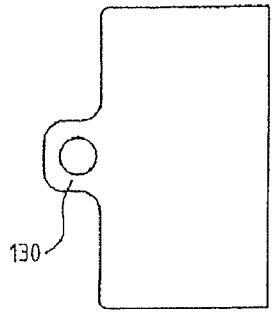
Figure 8:
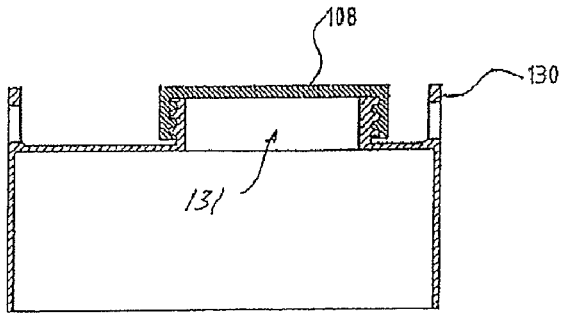

In at least one preferred form of this embodiment sealing end cap and filler end cap may be provided with projecting lifting or attachment lugs 130 as shown in FIG. 8 for the attachment of carrying slings or as an aid to securing the charge carrier in a location for use.

The above describes only some embodiments of the present invention and modifications, obvious to those skilled in the art, can be made thereto without departing from the scope and spirit of the invention.

The invention claimed is:

1. A linear charge system for applying a destructive linear explosive blast to a barrier structure; said system comprising a charge carrier and a linear explosive charge assembled within said charge carrier; said linear explosive charge adapted to effect a directed linear explosive blast for the penetration of a said barrier in which a tamping fluid forms at least a portion of a penetrating agent, and wherein said charge carrier is comprised of an elongate body of hollow section polymeric material; said elongate body provided with a sealing end cap at a first end and a filler end cap at a second end; said filler end cap provided with an aperture and closure means adapted to allow the filling of said body with said tamping fluid, and wherein the internal walls of said elongate body are coated with a gelling agent adapted to modify said tamping fluid into a tamping gel when said fluid is added to said elongate body.

2. The linear charge system of claim 1, wherein at least a portion of said tamping fluid is rearward of said linear explosive charge.

3. The linear charge system of claim 1, wherein at least a portion of said tamping fluid is forward of said linear explosive charge.

4. The linear charge system of claim 1, wherein said barrier structure includes domestic and commercial metal roller doors, metal doors, fire doors, reinforced timber doors and glass doors.

5. The linear charge system of claim 1, wherein said elongate body is provided with an adjustable foot element adapted to provide a height adjustment facility to said elongate body.

6. The linear charge system of claim 1, wherein said elongate body is provided with an adjustable hinged brace.

7. The linear charge system of claim 1, wherein said elongate body is provided with flexible magnetic strips disposed along portions of the front face of said body, said strips adapted to attach said charge carrier to a ferrous metal surface.

8. The linear charge system of claim 1, wherein said elongate body is provided with internal guide rails adapted to accept said linear explosive charge; said linear explosive charge comprising a loading card sliding into selected said internal guide rails as a sliding fit.

9. The linear charge system of claim 8, wherein said loading card comprises an elongate polymeric extrusion having front and rear wall separated by transverse dividing elements so as to form a number of longitudinal passages through the length of said loading card.

10. The linear charge system of claim 8, in which said loading card is provided with a series of slots and holes disposed at each end of said card; said holes and slots adapted to accept and retain a winding of detonating cord laid along the front face of said card so as to form said linear explosive charge.

11. The linear charge system of claim 10, wherein said linear explosive charge includes a flexible frangible explosive cutting sheet; said flexible frangible explosive cutting sheet placed in front of said detonating cord.

12. The linear charge system of claim 10, wherein said linear explosive charge comprises a flexible frangible explosive cutting sheet, the matrix of said cutting sheet containing a distributed explosive agent; said flexible frangible explosive cutting sheet positioned along said front face of said loading card.

13. The linear charge system of claim 8, wherein said elongate body, said sealing end cap, said filler end cap, said loading card, and said linear explosive charge are provided disassembled for assembly at a site for use.

* * * * *